US006029627A

United States Patent [19]

VanDyne

[11] Patent Number: 6,029,627

[45] Date of Patent: Feb. 29, 2000

[54] APPARATUS AND METHOD FOR CONTROLLING AIR/FUEL RATIO USING IONIZATION MEASUREMENTS

[75] Inventor: Edward VanDyne, Ashland, Mass.

[73] Assignee: Adrenaline Research, Inc., Hudson, Mass.

[21] Appl. No.: 09/025,988

[22] Filed: Feb. 19, 1998

Related U.S. Application Data

[60] Provisional application No. 60/037,973, Feb. 20, 1997.

[51] Int. Cl.[7] ..... F02D 41/14

[52] U.S. Cl. ..... 123/435; 73/116

[58] Field of Search ..... 123/406.26, 406.27, 123/406.28, 435, 568.21; 73/35.08, 116, 117.3

[56] References Cited

U.S. PATENT DOCUMENTS

| | | | |
|---|---|---|---|
| 4,003,248 | 1/1977 | Leichle | 73/116 |
| 4,307,603 | 12/1981 | Dobler et al. | 73/35 |
| 4,359,893 | 11/1982 | Kizler et al. | 73/115 |
| 4,491,110 | 1/1985 | Bone et al. | 123/425 |
| 4,515,132 | 5/1985 | Anderson et al. | 123/494 |
| 4,535,740 | 8/1985 | Ma | 123/435 |
| 4,547,734 | 10/1985 | Spaude | 324/395 |
| 4,557,236 | 12/1985 | Showalter | 123/435 |
| 4,716,874 | 1/1988 | Hilliard et al. | 123/425 |
| 4,964,388 | 10/1990 | Lefebvre | 123/435 |
| 5,197,448 | 3/1993 | Porreca et al. | 123/620 |
| 5,230,240 | 7/1993 | Ohsawa et al. | 73/116 |
| 5,253,627 | 10/1993 | Miyata et al. | 123/435 |
| 5,272,914 | 12/1993 | Murata et al. | 73/116 |
| 5,309,884 | 5/1994 | Fukui et al. | 123/481 |
| 5,321,978 | 6/1994 | Brandt et al. | 73/116 |
| 5,323,748 | 6/1994 | Foster et al. | 123/435 |
| 5,337,716 | 8/1994 | Fukui et al. | 123/425 |
| 5,347,855 | 9/1994 | Miyata et al. | 73/116 |
| 5,353,769 | 10/1994 | Maeda et al. | 123/492 |
| 5,359,882 | 11/1994 | Fukui | 73/117.3 |
| 5,365,910 | 11/1994 | Miyata et al. | 123/627 |
| 5,377,653 | 1/1995 | Hamada et al. | 123/655 |
| 5,383,350 | 1/1995 | Bennett et al. | 73/35 |
| 5,392,641 | 2/1995 | McCombie | 73/117.3 |
| 5,396,176 | 3/1995 | Ishii et al. | 324/388 |
| 5,397,990 | 3/1995 | Ohsawa | 324/399 |
| 5,424,647 | 6/1995 | Ohsawa et al. | 324/378 |
| 5,425,339 | 6/1995 | Fukui | 123/435 X |
| 5,452,603 | 9/1995 | Asano et al. | 73/116 |

FOREIGN PATENT DOCUMENTS

| | | |
|---|---|---|
| 2675206 | 4/1991 | France . |
| WO96/22458 | 7/1996 | WIPO . |

OTHER PUBLICATIONS

SAE Technical Paper 980166, "In–Cylinder Air/Fuel Ratio Approximation Using Spark Gap Ionization Sensing", Eric N. Balles et al, Feb. 1998.

(List continued on next page.)

*Primary Examiner*—Terry M. Argenbright
*Attorney, Agent, or Firm*—Choate, Hall & Stewart

[57] ABSTRACT

An air/fuel ratio control system for an internal combustion engine to reduce emissions and increase engine efficiencies includes an ionization apparatus for detecting and measuring ionization within a combustion cylinder and generating an ionization signal based upon the ionization detection and measurements. Also included is an air/fuel ratio controller in electrical communication with the ionization apparatus. The controller receives the ionization signal and controls the air/fuel ratio in the engine based at least in part upon the ionization signal. In a preferred embodiment of the control system, the controller controls the air/fuel ratio based upon a first local peak in the ionization signal. In another embodiment, the controller controls the air/fuel ratio based upon maximizing the first local peak in the ionization signal.

26 Claims, 7 Drawing Sheets

OTHER PUBLICATIONS

"Patent Abstracts of Japan", vol. 18, No. 27 (M1543), abstract of JP–05–263679, Jan. 1994.
"Patent Abstracts of Japan", vol. 095, NO. 005, abstract of JP–07–42592, Jun. 1995.
"Flame Ion Density Measurement Using Spark Plug Voltage Analysis" Miyata et al., *International Congress and Exposition*, Detroit, Michigan (Mar. 1–5, 1993).
"Investigation of In–cylinder Fluid Motion Using a Head Gasket Instrumented with Ionization Probes" Witze et al., *International Congress and Exposition*, Detroit, Michigan (Feb. 25–Mar. 1, 1991).
"Detection of Abnormal Flame Fronts in Road Tests with an Engine Using Independent Ionization Gaps" Landis, *SAE Summer Meeting*, Atlantic City, New Jersey (Jun. 6–11, 1954).
"A Flame Ionization Technique for Measuring Total Hydrocarbons in Diesel Exhaust" Johnson et al., *International Harvester Company*.
"Diesel Exhaust Hydrocarbon Measurement—A Flame–Ionization Method" Springer et al., *Automotive Engineering Congress*, Detroit, Michigan (Jan. 12–16, 1970).
"A Recommended Flame Ionization Detector Procedure for Automotive Exhaust Hydrocarbons" Teague et al., *SAE Mid–Year Meeting*, Detroit, Michigan (May 18–22, 1970).
"Turbulent Flame Structure as Determined by Pressure Development and Ionization Intensity" Arrigoni et al., *International Automotive Engineering Congress*, Detroit Michigan (Jan. 8–12, 1973).
"Chemi–Ionization and Carbon in a Spark Ignition Engine" Arrigoni et al., *Automotive Engineering Congress*, Detroit Michigan (Feb. 25–Mar. 1, 1974).
"Significance of Burn Types, as Measured by Using the Spark Plugs as Ionization Probes, with Respect to the Hydrocarbon Emission Levels in S.I. Engines" Rado et al., *Automotive Engineering Congress and Exposition*, Detroit, Michigan (Feb 24–28, 1975).
"Optimization of a Flame Ionization Detector for Determination of Hydrocarbon in Diluted Automotive Exhausts" Reschke, *International Automotive Engineering Congress and Exposition*, Detroit, Michigan (Feb. 28–Mar. 4, 1977).
"Improving the Method of Hydrocarbon Analysis" Staab et al., *International Congress and Exposition*, Detroit, Michigan (Feb. 23–27, 1981).
"Cycle by Cycle Variations of Flame Propagation in a Spark Ignition Engine" Petrovic, *International Congress and Exposition*, Detroit, Michigan (Feb. 22–26, 1982).
"In–Cylinder Measurement of Combustion Characteristics Using Ionization Sensors" Anderson, *International Congress and Exposition*, Detroit, Michigan (Feb. 24–28, 1986).
"Exhaust Gas Ionization Sensor for Spark Ignition Engines" Williams et al., *I Mech E,* C59/88, (1988).
"Ionization Sensors for Feedback Control of Gasoline Engines"Collings et al. (1988).
"An Exhaust Ionizaiton Sensor for Detection of Late Combustion with EGR" Brehob, *International Fuels and Lubricants Meeting and Exposition*, Baltimore, Maryland (Sep. 25–28, 1989).
"Cycle–Resolved Multipoint Ionization Probe Measurements in a Spark Ignition Engine" Witze, *International Fuels and Lubricants Meeting and Exposition*, Baltimore, Maryland (Sep. 25–28, 1989).
"In–Cylinder Measurements of Residual Gas Concentration in a Spark Ignition Engine" Galliot et al., *International Congress and Exposition*, Detroit, Michigan (Feb. 26–Mar. 2, 1990).
"Unburnt Hydrocarbon Measurement by Means of a Surface Ionisation Detector" Cai et al. (1991).
"Analysis of RF Corona Discharge Plasma Ignition" Van Voorhies et al. (1992).
"Flame Location Measurements in a Production Engine Using Ionization Probes Embodied in a Printed–Circuit–Board Head Gasket" Nicholson et al., *International Congress and Exposition*, Detroit, Michigan (Mar. 1–5, 1993).
"Simultaneous Application of Optical Spark Plug Probe and Head Gasket Ionization Probe to a Production Engine" Meyer et al., *International Congress and Exposition*, Detroit, Michigan (Mar. 1–5, 1993).
"Determining the Location of End–Gas Autoignition Using Ionization Probes Installed in the Head Gasket" Witze et al., *Fuels and Lubricants Meeting and Exposition*, Philadelphia, Pennsylvania (Oct. 18–21, 1993).

APPARATUS AND METHOD FOR CONTROLLING AIR/FUEL RATIO USING IONIZATION MEASUREMENTS

This application claims the benefit of U.S. Provisional Application No. 60/037,973, filed Feb. 20, 1997, and titled "Apparatus and Method For Controlling Air/Fuel Ratio Using Ionization Measurements".

BACKGROUND OF THE INVENTION

This invention relates generally to ignition systems in internal combustion engines and, more particularly, relates to an apparatus and method for utilizing ionization measurement for air/fuel ratio control to reduce engine emissions and increase engine efficiencies.

It is necessary to control the air/fuel ratio introduced into the cylinders of internal combustion engines for many reasons including emissions control, engine efficiency, catalytic converter efficiency, catalytic converter longevity and engine power. Numerous methods and apparatuses exist in the prior art to control the air/fuel ratio especially in light of governmental pressures to reduce certain emissions. Overall control of internal combustion engines is currently premised on the reading of various engine operating parameters such as engine speed, intake manifold pressure, coolant temperature, throttle position, and exhaust oxygen concentration. These parameters are used in conjunction with specific, predetermined base maps calibrated by a baseline engine to select the ignition timing, fuel injector duration, and exhaust gas recirculation ("EGR") of the engine so that the engine achieves maximum efficiency and minimum emissions as determined by the baseline engine.

Present engine control systems, and more specifically, air/fuel ratio control systems, do not adequately control internal combustion engines so that maximum efficiency and reduced emissions are achieved. For example, U.S. Pat. No. 4,543,934 provides a fuel-air mixture dilution control system by monitoring cycle-to-cycle fluctuations of the angular position of peak combustion pressure of each engine cylinder. This control system determines an air/fuel ratio at which engine stability changes between stable and unstable conditions. A controller attempts to continuously operate the engine at the engine stability point, leaning the fuel-air mixture until the engine becomes unstable, and enriching the fuel-air mixture until the engine becomes stable again. This stability point is often beyond the point of maximum efficiency and is also often beyond the point of minimum emissions. Other control systems, such as the system disclosed in U.S. Pat. No. 4,736,724, control the air/fuel ratio by measuring the burn duration of each engine cylinder. The duration is compared to an adaptive engine map that determines the lean limit for the engine at a specific speed and load. The engine is then controlled to operate at the most dilute point possible for a desired engine stability, but this point is often beyond the point of maximum efficiency, and is often beyond the point of minimum emissions. U.S. Pat. No. 4,621,603 discloses three different methods of controlling the level of fuel-air mixture dilution using pressure ratio management. The first system controls the amount of diluent at a specified value as a function of engine speed and load. The second system controls the amount of diluent to adjust the burn rate or combustion time. The third system controls the amount of diluent using cycle-to-cycle variability as both a method to balance fuel delivery to each combustion chamber, and as a method of stability control. Pressure ratio management allows for a simplified algorithm, but again does not supply the engine controller with enough information for complete engine control because taking pressure readings only at specific points allows the controller only to estimate engine stability, and therefore, this system suffers the same limitations of the previously mentioned systems. Alternatively, the system of U.S. Pat. No. 4,621,603 could be used at a specific air/fuel ratio that is calculated according to base maps, but even with an adaptive algorithm, the pressure ratio does not give enough information to allow the system to provide both maximum efficiency and minimum emissions. The system in U.S. Pat. No. 4,621,603, for example, would have extreme difficulty calculating the engine mean effective pressure if spark timing varies by large amounts. Such a calculation is necessary for an engine to achieve maximum efficiency at highly dilute mixtures and minimum emissions.

An important consideration in air/fuel ratio control methodology is catalytic converter performance. In order to optimize catalytic converter performance, a stoichiometric air/fuel ratio (about 14.7 to 1 for gasoline) is desirable. This is because with rich air/fuel ratios (i.e., less than 14.7 to 1) the fuel does not completely combust and the resulting emissions tend to clog the catalytic converter. A lean mixture (i.e., greater than 14.7 to 1), on the other side of stoichiometric, results in excess oxygen ("$O_2$") in the emissions which in turn causes the operating temperature of the catalytic converter to rise and reduces or prevents the conversion of nitrogen-oxygen compounds ("$NO_x$"). Exposure to elevated temperatures sharply reduces the operating life of the catalytic converter. In sum, catalytic converters are at their most efficient when a stoichiometric air/fuel ratio is used in the engine cylinders.

Most air/fuel ratio control methods use oxygen sensors in the exhaust system of the engine to measure the presence of oxygen which is indicative of whether the engine is running at stoichiometric mixtures. The $O_2$ sensor measures the $O_2$ in the exhaust of the engine in either the exhaust manifold or the exhaust pipe. One drawback to using an $O_2$ sensor in the exhaust manifold or pipe is that the sensor reads a global air/fuel ratio for all engine cylinders. If one cylinder runs lean because, for example, a fuel injector is clogged, an air/fuel ratio controller that is based upon the $O_2$ sensor will cause the other cylinders to run more richly thereby maintaining the desired global air/fuel ratio. Such a system achieves an average stoichiometric air/fuel ratio for all the cylinders, even though individual cylinders may be running at undesirably rich or lean mixtures.

There have been a number of attempts using $O_2$ sensors to replace the above-described global emissions control with control of the air/fuel ratios in individual cylinders. The most common method of individually controlling the air/fuel ratio is to utilize fast acting $O_2$ sensors to discern the exhaust $O_2$ from each of the cylinders individually. The primary drawback with this implementation is that the $O_2$ sensors are down-stream from the cylinders. The physical separation between the cylinder where combustion takes place and the sensor which measures the combustion characteristics introduces time delays, error and control difficulties. It is exceedingly difficult to calibrate this type of air/fuel ratio control system to account for the time delay and error at all engine speeds. Additionally, in some current production engines, four or more $O_2$ sensors are required for this type of control thereby increasing the cost of implementation.

A relatively recent development allows certain in-cylinder combustion characteristics to be monitored. This monitoring technology revolves around electrically analyzing the gases in the cylinder before, during and after combustion. These gases present in the cylinder include free ions which result from the combustion reaction.

The free ions present in the combustion gases are electrically conductive, and therefore measurable by applying a voltage across either an ionization probe or across the tip of a spark plug. The applied voltage induces a current in the ionized gases which can be measured to provide an ionization signal for analysis. For an example of ionization detection using the tip of a spark plug, see "Ignition System With Ionization Detection", U.S. Pat. No. 5,777,216, issued Jul. 7, 1998 which is commonly owned with the present invention and incorporated herein by reference.

There have been some attempts in the prior art to correlate an ionization signal to air/fuel ratios. The prior art strongly suggests, however, that feedback control of the air/fuel ratio in internal combustion engines based upon ionization signal data is impossible. See N. Callings et al., "Ignition Sensors for Feedback Control of Gasoline Engines", SAE Technical Paper Series No. 884711, 1988, pp. 43–47; R.L. Anderson, "In-Cylinder Measurement of Combustion Characteristics Using Ionization Sensors", SAE Technical Paper Series No. 860485, 1986, pp. 113–124.

In view of the foregoing, an object of the present invention to provide an improved control system and method for regulating the air/fuel ratio introduced into the cylinder of an internal combustion engine.

Another object of the present invention is to provide an improved control system and method of controlling the air/fuel ratio in an internal combustion engine based at least in part upon ionization detection.

Yet another object of the present invention is to provide a control system and method for controlling the air/fuel ratio in an internal combustion engine based upon an ionization signal derived from an ionization detection apparatus.

Still another object of the present invention is to provide a method for controlling the air/fuel ratio in an internal combustion engine that is inexpensive and efficient.

SUMMARY OF THE INVENTION

The foregoing objects are among those attained by the invention, which provides an air/fuel ratio control system for an internal combustion engine to reduce emissions and increase engine efficiencies and includes in one aspect an ionization apparatus for measuring ionization within a combustion chamber of the engine and generating an ionization signal based upon the ionization measurements. Also included is an air/fuel ratio controller in electrical communication with the ionization apparatus. The controller receives the ionization signal and controls the air/fuel ratio in the engine based at least in part upon the ionization signal.

In another embodiment of the control system, the controller controls the air/fuel ratio based upon a first local peak in the ionization signal. In another embodiment, the controller controls the air/fuel ratio based upon maximizing the first local peak in the ionization signal. Another variation of the control system includes a processor for conditioning the ionization signal. The controller controls the air/fuel ratio based upon a the conditioned ionization signal.

In another embodiment the controller controls the air/fuel ratio to substantially maximize or minimize a second local peak in the ionization signal.

In still another preferred embodiment, the combustion chamber of the internal combustion engine includes a plurality of cylinders. Each cylinder is independently coupled to an ionization apparatus for detecting ionization within the cylinder and generating an ionization signal based upon the ionization measurements. The controller may independently control the air/fuel ratio two or more of the cylinders. The ionization measuring apparatus may further comprise a spark plug or an ionization probe in the cylinder for generating the ionization signal.

A method for reducing emissions and increasing engine efficiencies in an internal combustion engine is also disclosed. The method includes detecting ionization within a combustion cylinder of the engine with an ionization apparatus and generating an ionization signal with the ionization apparatus based upon the ionization detection. The method further includes a step of adjusting an air/fuel mixture injected into the cylinder based upon the ionization signal.

The adjusting step of the method may be based on a number of features of the ionization signal, including a first local peak, maximizing the first local peak, a second local peak or maximizing and/or minimizing the second local peak. The method may further include a step of comparing the first local peak of the ionization signal of a first cylinder with a first local peak of the ionization signal of a second cylinder. And may also be based upon maintaining the first local peaks of the first and second cylinder at substantially equal amplitudes.

DESCRIPTION OF PREFERRED EMBODIMENTS

Figure 1:
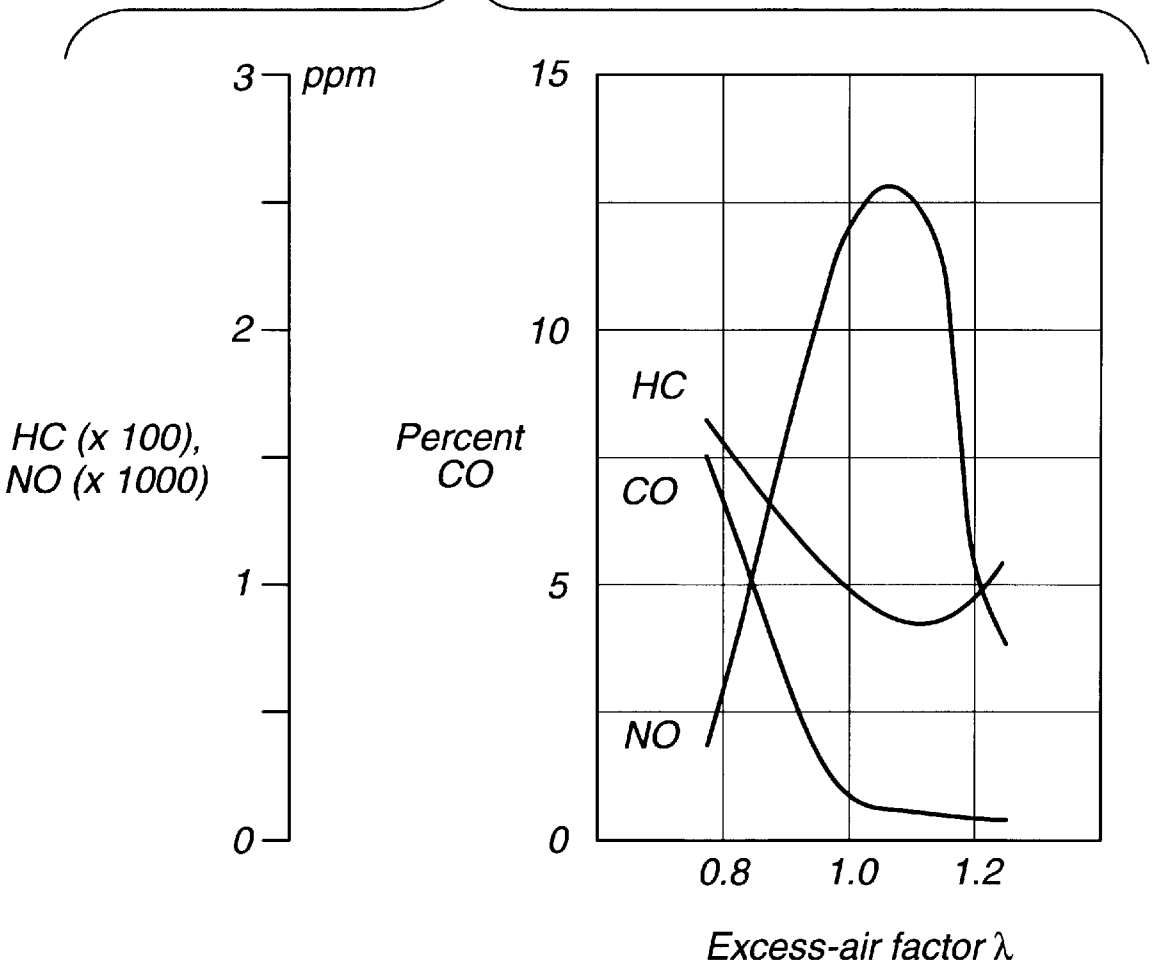
FIG. 1 is a graphical depiction of various emissions (specifically the gases CO, NO and HC) versus the excess air factor ("λ"; defined below) for a typical internal combustion engine.

Referring initially to FIG. 1, a graph depicting various emissions gases versus an excess-air factor ("λ") for a typical engine under typical operating conditions is shown. FIG. 1 is derived from the Bosch Automotive Handbook, 1986, page 439. As used herein, the excess-air factor (λ) is simply a factor indicating the amount that the air/fuel ratio is above or below a stoichiometric mixture (e.g., 14.7 to 1 for gasoline). Thus, for example, $\lambda=1$ corresponds to an air/fuel ratio equal to stoichiometric, $\lambda=1.2$ corresponds to an air/fuel ratio that is 120% of stoichiometric, $\lambda=0.8$ corresponds to an air/fuel ratio that is 80% of stoichiometric, and $\lambda=2$ corresponds to an air/fuel ratio twice stoichiometric (e.g., 29.4 to 1 for gasoline).

It is seen in FIG. 1 that the concentration of NO peaks at a value slightly leaner ($\lambda>1$) than a stoichiometric air/fuel ratio. The presence of NO is a sample representation of the presence of all $NO_x$. gases.

As explained above, ionization detection and measurement is known in the art. One type of ionization detection apparatus for detecting and measuring ionization includes a spark plug which utilizes a spark gap across which a voltage is applied. The voltage across the spark gap induces a current (across the spark gap) in the ionization gases during and after combustion. The current is detected by a circuit and analyzed to determine combustion characteristics. See, for example, "Ignition System With Ionization Detection", U.S. Pat. No. 5,777,216, incorporated herein by reference. Another ionization detection apparatus employs a probe, similar to the spark plug, except its primary function is to detect ionization gases.

Figure 2:
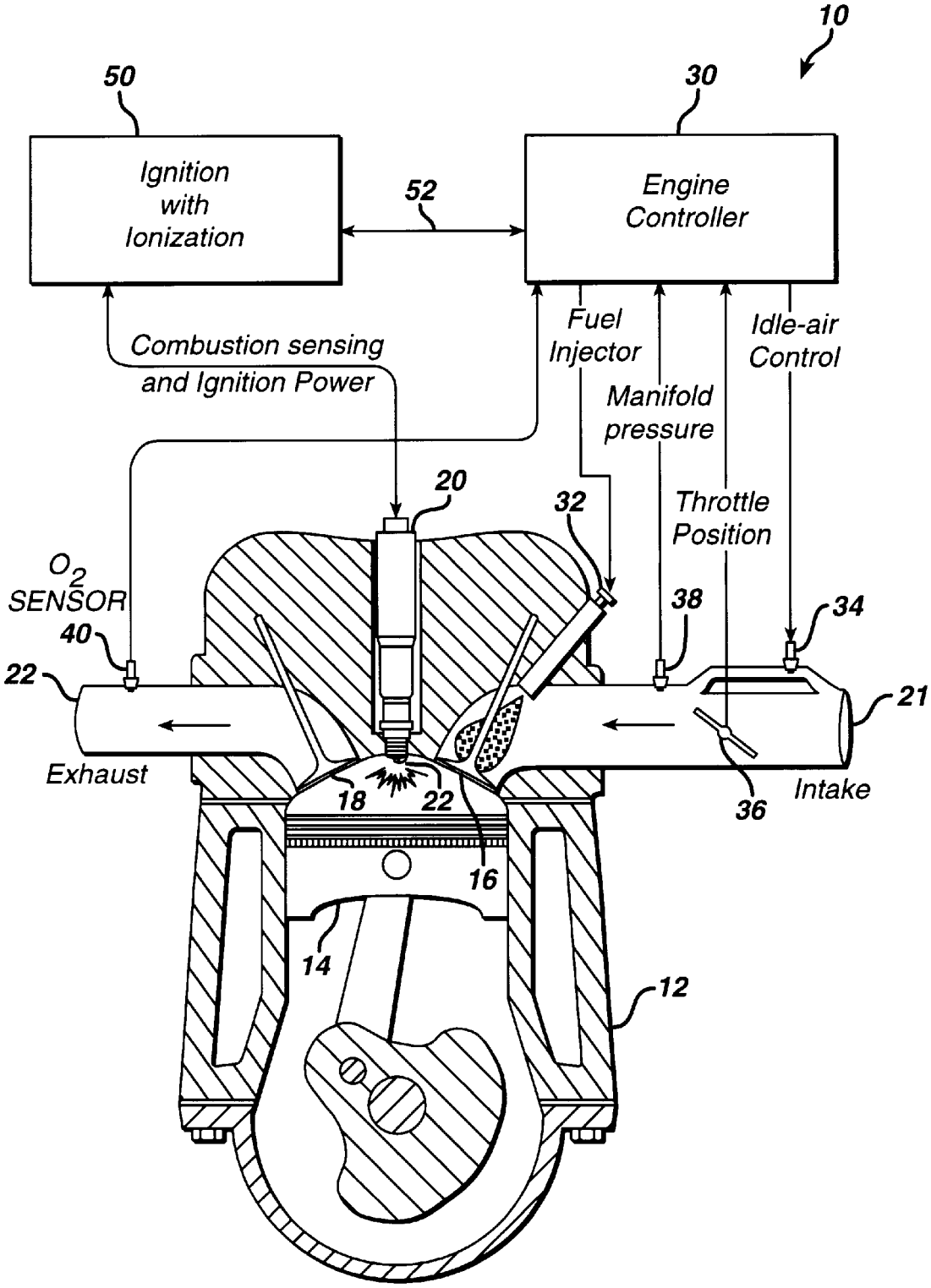
FIG. 2 is a schematic view depicting an air/fuel ratio control system of the present invention.

Turning now to FIG. 2, a control system 10 according to the present invention is shown. An internal combustion engine (not shown) includes a cylinder 12, a piston 14, an intake valve 16 and an exhaust valve 18. An intake manifold 20 is in communication with the cylinder 12 through the intake valve 16. An exhaust manifold 22 receives exhaust gases from the cylinder 12 via the exhaust valve 18. A spark plug 20 with a spark gap 22 ignites the air and fuel in cylinder 12.

A conventional engine controller 30 typically controls various engine operating parameters and components including fuel injector 32 and idle air valve 34. The engine controller 30 also receives position data from a throttle position sensor (not shown) coupled to a throttle valve 36 and manifold pressure data from a manifold pressure sensor 38. The throttle valve 36 provided in the intake manifold 20 controls air flow to the cylinder 12. The engine controller 30 also typically receives data from an $O_2$ sensor 40 located in the exhaust manifold 22 or elsewhere downstream from the exhaust valve 18.

An ionization detection apparatus 50 includes an ionization detector which, as shown in FIG. 2, comprises spark plug 20 located partially in the cylinder to detect ionization in the cylinder 12. The ionization detected by the spark plug or ionization detector 20 is communicated to the ionization apparatus 50. The ionization apparatus 50 receives ionization data from the ionization detector (either the spark plug 20, an ionization probe or any another conventional device for detecting ionization) and communicates an ionization signal 52 to the engine controller 30.

The engine controller 30 controls the fuel injector 32 and may control the throttle valve 36 to deliver air and fuel, at a desired ratio, to the cylinder 12. The engine controller 30 may be any conventional controller adapted to receive feedback, in the form of ionization signal 52, from the ionization apparatus 50 to adjust the air/fuel ratio. The use of the ionization signal 52 by the engine controller is described more fully below.

Figure 3:
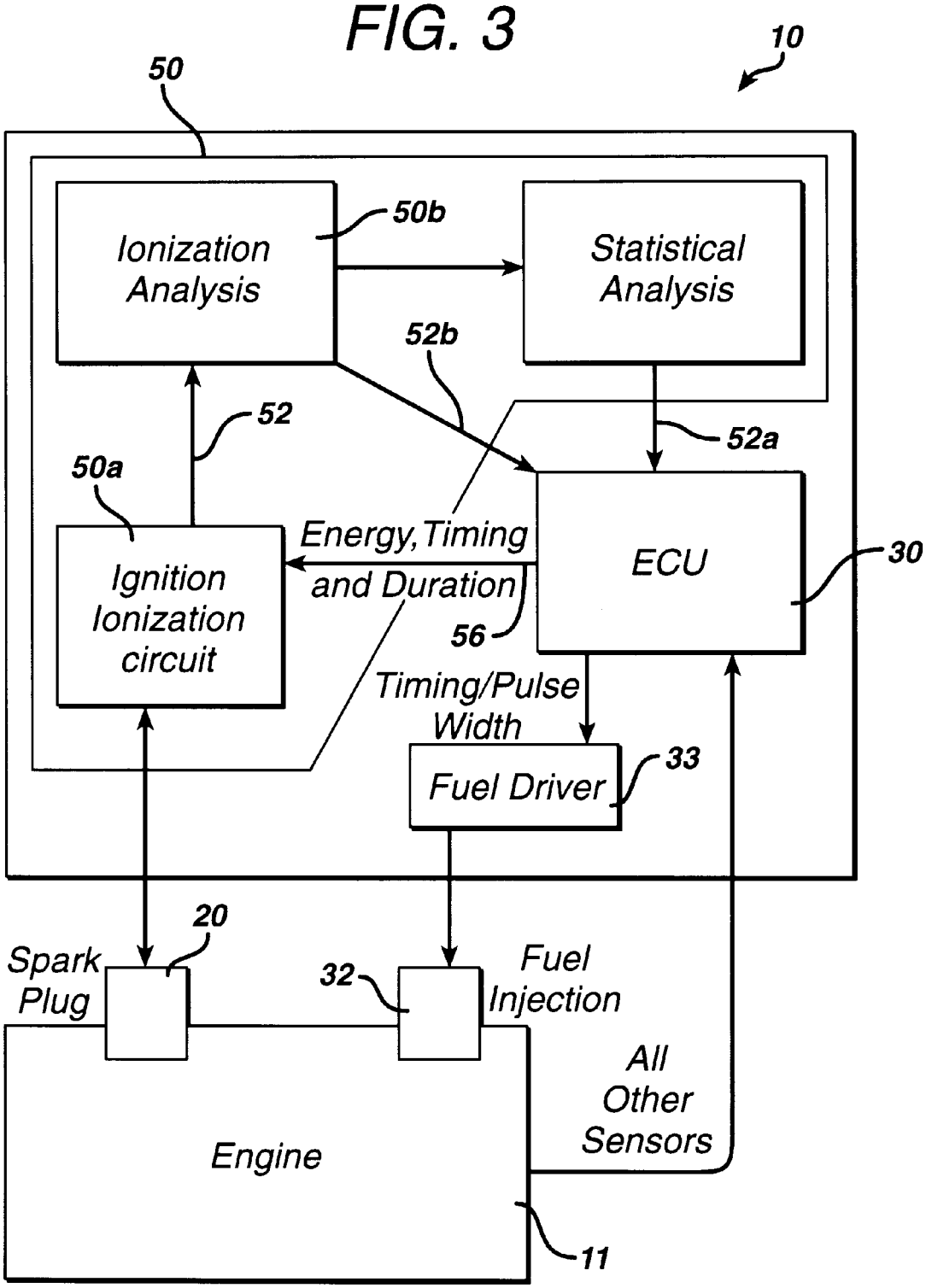
FIG. 3 is block diagram of the air/fuel ratio control system of the present invention.

In FIG. 3, there is shown a block diagram of the control system 10 in accordance with the present invention. Engine 11 includes the spark plug 20 which, in this embodiment, provides ionization detection (other ionization detection apparatus may also be used such as an ionization probe). The ionization apparatus 50 receives ionization detection data from the spark plug 20 and converts it into an ionization signal 52. The ionization signal 52 is processed and analyzed, which may include a statistical analysis (explained further below), in processor 50*b*. Processed ionization signals 52*a* and 52*b* are transmitted to the engine controller 30 (also commonly referred to as an engine control unit ("ECU")) which in turn provides the ionization apparatus 50 with other engine data including engine speed, ignition timing and ignition duration via signal 56. The engine controller 30 also receives data from other engine sensors such as engine speed and $O_2$ sensor data. Among other operating parameters, the engine controller 30 controls the fuel introduced into the engine 11 via the fuel injector 32 and fuel pump 33. The engine controller may also control the air introduced to the engine (not shown in FIG. 3). The engine controller 30 (or ECU) may thereby control the air/fuel ratio based at least in part on the ionization signal 52.

The ionization apparatus 50 includes an ionization circuit 50*a* and may also include a processor 50*b*. The processor may include analysis software, including statistical analysis routines for analyzing the ionization signal 52. The ionization apparatus may further include conventional buffers and memory for storing the ionization signal 52 and the processed signals 52*a*, 52*b*.

Figure 4:
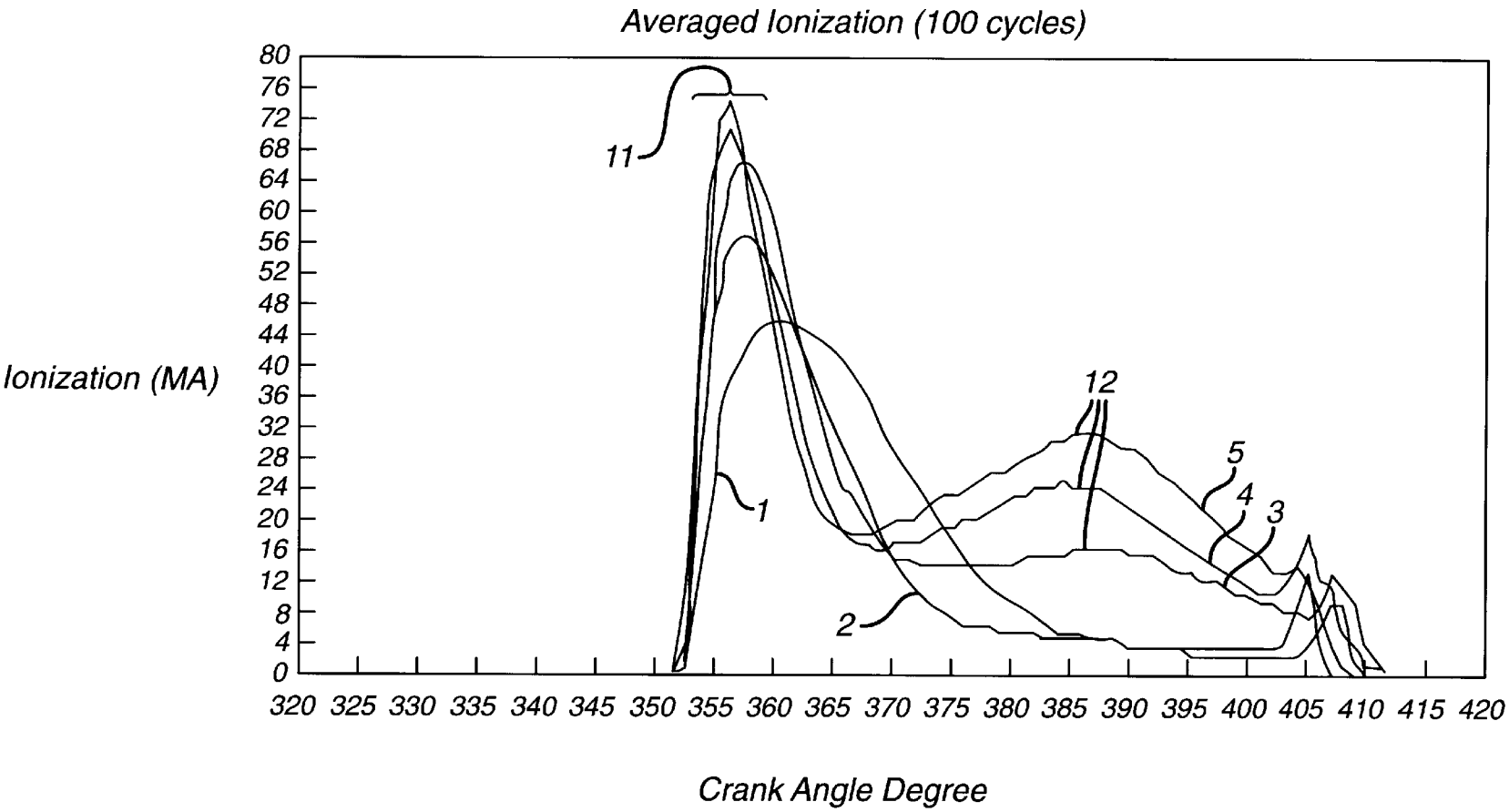
FIG. 4 is a graphical presentation of experimental data showing ionization current versus engine piston crank angle for various engine load conditions.

In FIG. 4 there are shown experimental data that include a statistical average of 100 combustion cycles of ionization data at five different load levels on a particular engine. The curves in FIG. 4 are labeled 1, 2, 3, 4 and 5 and represent the ionization signal (as a current in milliamperes) as a function of piston crank angle (in degrees; wherein 360 degrees is top dead center) for different and increasing engine loads, respectively.

In general, chemi-ionization in the flame zone is primarily responsible for the measured ionization data. However, there are two local peaks 11, 12 seen in these curves. The first local peak 11 primarily relates to flame speed in the engine cylinder. Clearly, when the air and fuel combust, the chemical reaction sharply increases the number of ions present in the cylinder chamber, and hence ionization detection increases.

The second local peak 12 seen in some of the curves of FIG. 4 relates to temperature and pressure-based ionization and concentration. The second local peak is primarily related to the presence of $NO_x$ molecules or $NO_x$ emissions developed during the combustion process. When the temperature and pressure in the cylinder increase immediately after combustion occurs, the concentration and production of $NO_x$ correspondingly increases. It is seen that the curves 1, 2 corresponding to lower load levels do not have a second local peak. This is because the load level is too low to generate sufficient temperature and pressure to increase the quantity and concentration of $NO_x$ and cause a second local peak in the ionization signal. In curves 3, 4 and 5, the increase in load and resulting increase in pressure from the combustion process increases the temperature and the $NO_x$ emissions, thereby producing increased ionization (and increased concentration of the ions) in the cylinder and resulting in an ionization curve with a second local peak at 12.

Figure 5:
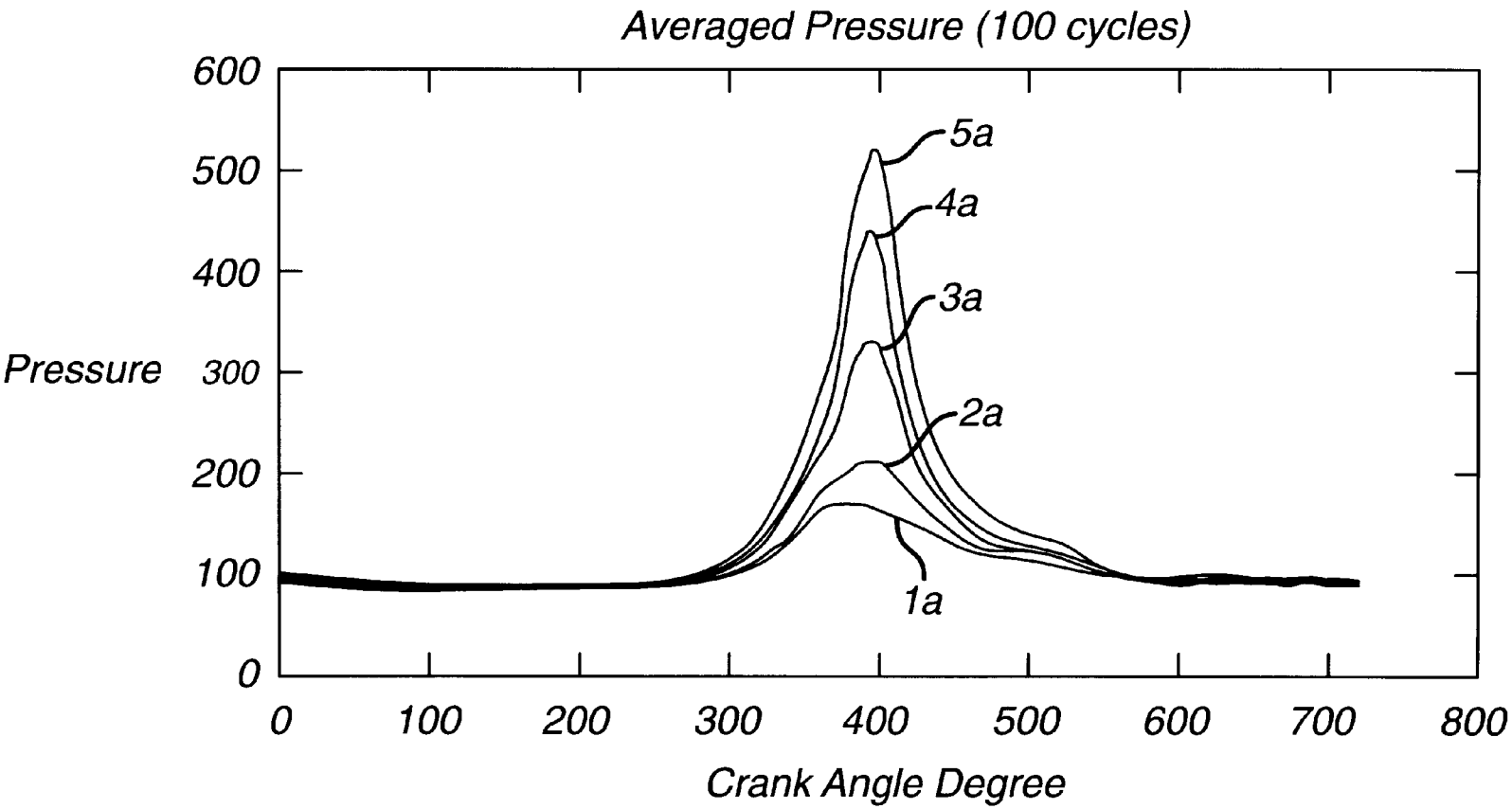
FIG. 5 is a graphical presentation of experimental data showing cylinder pressure versus engine piston crank angle for various engine load conditions.

As seen in FIG. 5, the second local peak 12 accurately locates (in the combustion cycle) the peak pressure in the cylinder. The curves in FIG. 5 are labeled 1*a*, 2*a*, 3*a*, 4*a* and 5*a* and represent relative average pressure over 100 combustion cycles as a function of piston crank angle (in degrees; wherein 360 degrees is top dead center) for different and increasing engine loads, respectively. These curves directly correspond to and are measurements from the same test as the curves shown in FIG. 4. In FIG. 5, it is seen that the peak pressure in the cylinder occurs at approximately 395 degrees. This is approximately the same location as the second local peak 12 of curves 3, 4 and 5 shown in FIG. 4. Thus, by determining the location of the second local peak 12 from the ionization data, the location of the peak pressure can be derived from the ionization data.

The ionization information in FIG. 4 can be statistically processed and analyzed to provide data that is averaged over numerous combustion cycles and has noise from cycle to cycle variations filtered out. Statistical processing and analysis may use any of a number of conventional statistical methods on the overall ionization data, and these are especially useful in the analysis of the first local peak 11 (the flame propagation portion) as well as the maximum intensity and location of the second local peak 12 (the pressure and temperature portion).

Figure 6:
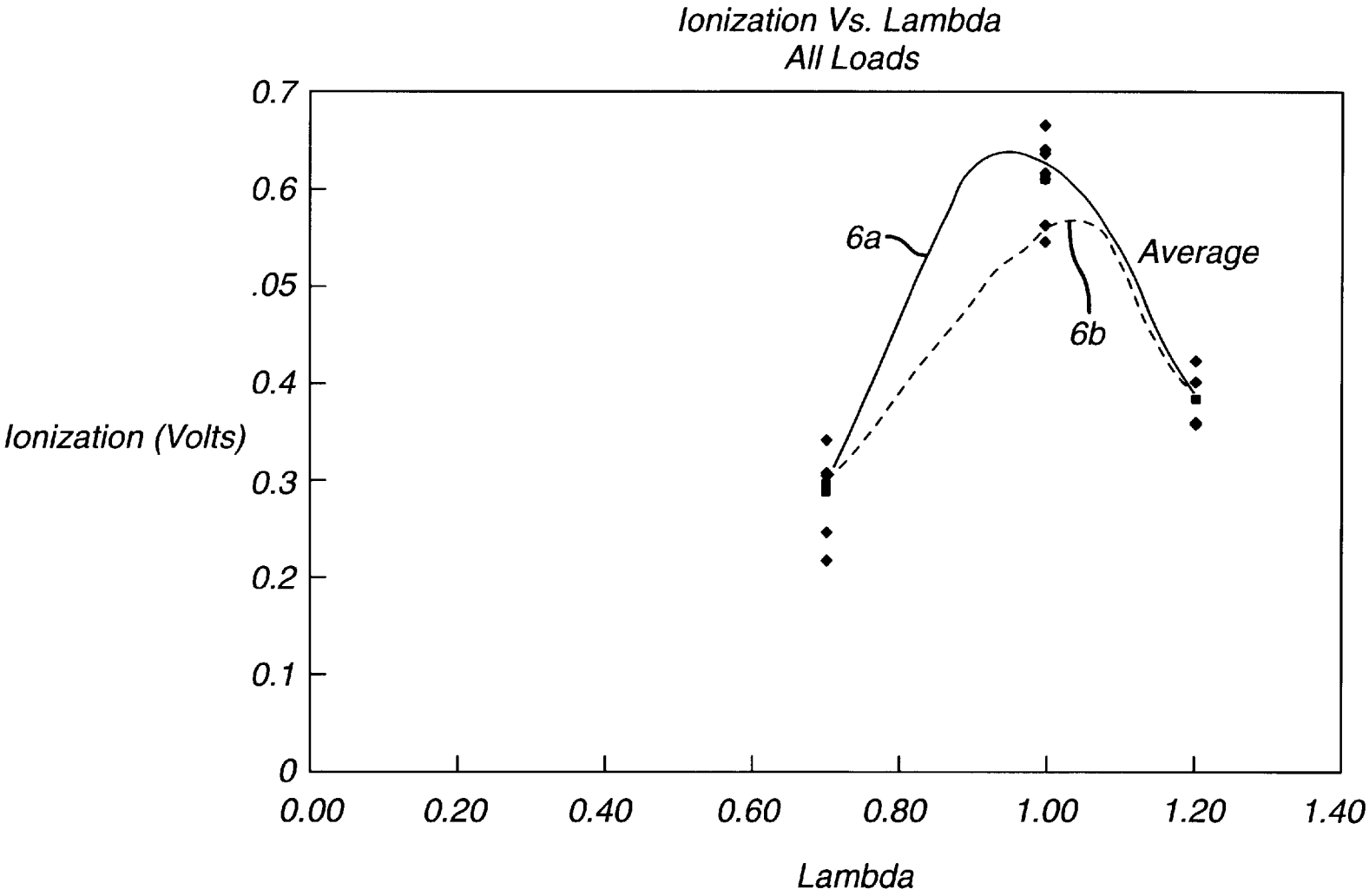
FIG. 6 is a graphical presentation of experimental data showing a correlation between the excess air factor (λ) and ionization for numerous engine load conditions.

Turning now to FIG. 6, experimental data measuring the first local peak of the ionization signal as a function of $\lambda$ is shown. The measured ionization was converted into an ionization signal in volts. The data shown as curve 6*a* is the first local peak (the flame ionization portion) of the ionization signal versus $\lambda$ (i.e., various air/fuel ratio conditions). The curve 6*a* roughly drawn through the data points reaches a maximum between approximately $\lambda$=0.90 and $\lambda$=0.95.

A similar curve, curve 6*b*, represents the second local peak of the ionization signal as a function of $\lambda$. This curve 6*b* reaches its maximum at approximately $\lambda$=1.00 to 1.10.

Thus, as air/fuel ratio is varied (rather than as a function of piston crank angle as in FIGS. 4 and 5) over numerous engine cycles, the first local peak of the ionization signal will reach a maximum in the range of $\lambda$=0.90 to 0.95. The second local peak of the ionization signal will reach a maximum in the range of $\lambda$=1.00 to 1.10. As discussed above, in order for there to be a second local peak, the load on the engine must be sufficiently high to raise the temperature and pressure in the cylinder to promote creation and concentration of $NO_x$ molecules. This effect must be great enough so that the second local peak has a sufficient magnitude to be detected.

For the reason that the second local peak is more difficult to measure, the first local peak in the ionization signal is the more reliable of the two local peaks to be used for air/fuel ratio control. Based on the data depicted in FIGS. 4 and 6, it is clear that the magnitude of the first local peak 11 in the ionization curves 1, 2, 3, 4 and 5, can change as a function of both $\lambda$ and load. It is therefore important to insure that minimum load variation when compiling statistical averages to analyze the air/fuel ratio and optimize the air/fuel ratio. This can be accomplished by insuring that ignition timing, mass air flow and engine revolutions per minute ("rpm") are held constant during the change in air/fuel ratio that is associated with the optimization process. It is also possible to make the changes to only one cylinder at a time, in order to determine the statistical information for that cylinder, without affecting the load of the overall engine.

Figure 7:
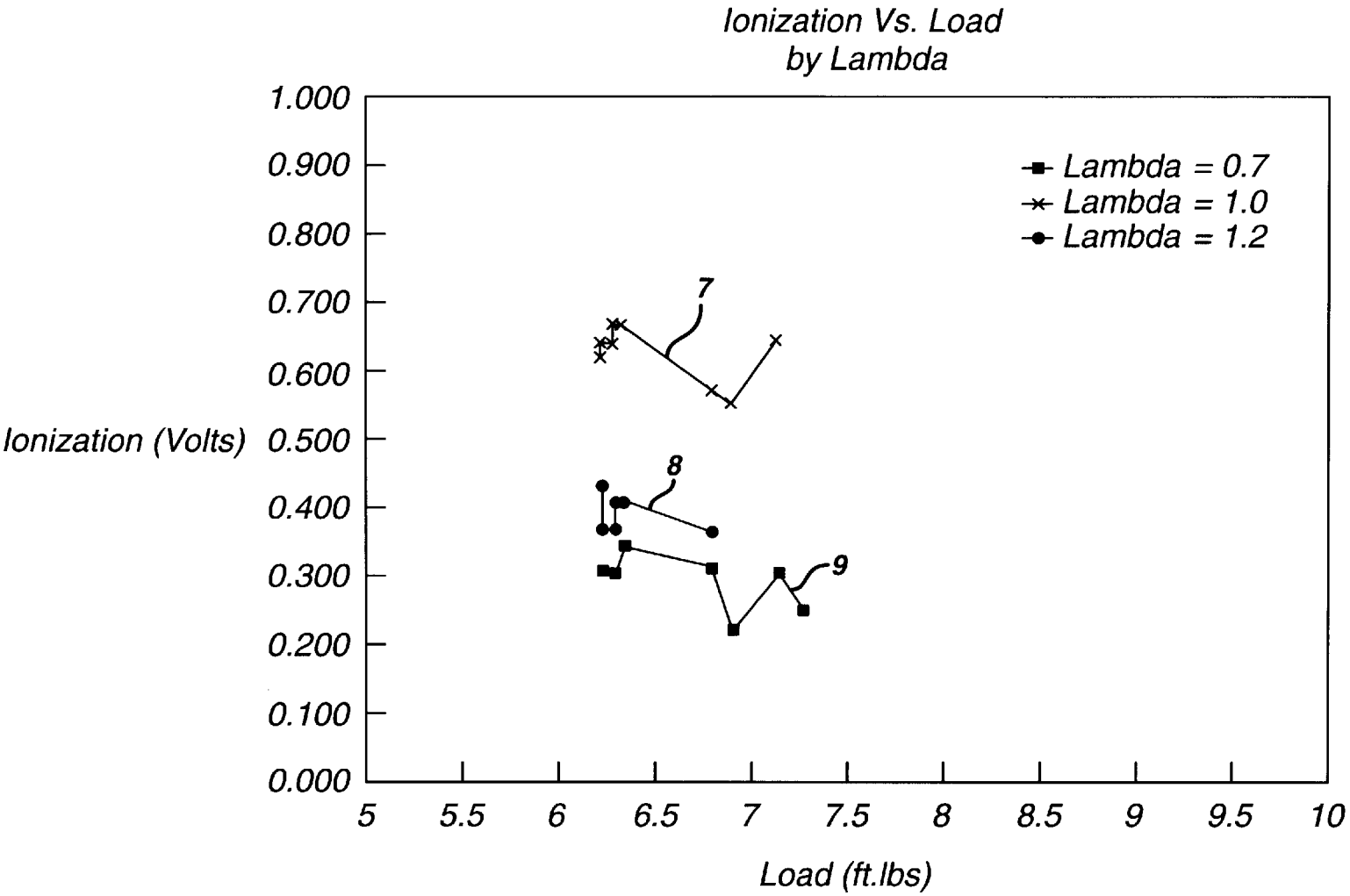
FIG. 7 is a graphical presentation of experimental data showing ionization versus engine load for various values of the excess air factor (λ).

FIG. 7 shows a graph of the first local peak of the ionization signal versus load for three different air/fuel ratios. The topmost curve 7 is for $\lambda$=1. The other curves 8, 9 are for $\lambda$=1.2 and $\lambda$=0.7, respectively. It is apparent from FIG. 7 that over a certain range of cylinder loading conditions, the ionization level for stoichiometric air/fuel mixtures is higher (and measurably so) than that for air/fuel mixtures corresponding to $\lambda$=1.2 and 0.7.

A preferred method of achieving a stoichiometric mixture in each cylinder utilizes a single $O_2$ sensor and air/fuel ratio control based upon the ionization signal in each individual cylinder. At least one $O_2$ sensor in the exhaust system of the engine is probably required in engines with a catalytic converter. A global determination (rather than cylinder-by-cylinder) of exhaust gases may be necessary because there is usually just one catalytic converter in the exhaust system of the engine. The $O_2$ sensor in the exhaust is used to determine the total or global stoichiometric mixture of the engine.

The engine controller then utilizes methodology for equalizing the amplitude or the location (or both) of first local peak of the ionization signal in each individual cylinder. When statistical equality in the individual cylinders is achieved with an air/fuel mixture at stoichiometry based on the $O_2$ sensor, and knowing the slope of the first local peak of the ionization signal relative the stoichiometric mixture, the engine will be in balance. In this type of system, the ionization is used as a balancing mechanism for improving catalyst efficiency by maintaining a mixture closer to stoichiometric in all cylinders, as compared to current production systems that utilize multiple exhaust oxygen seniors, in order to get sensitivity to the individual cylinders, as well as to the global engine air/fuel ratio.

One preferred method for controlling a stoichiometric mixture for each cylinder is to approximately equalize the statistical first local peak of the ionization signal amongst all cylinders for a given engine operating condition. Because of the slope of the ionization curve, perturbations of the air/fuel ratio from rich to lean of stoichiometric will be readily detected. The lean cylinders will have significantly different first local peak (of the ionization signal) amplitudes as compared to the rich cylinders. This will give a clear indication of which cylinders are running rich, and which are running lean, thereby allowing the system to achieve a better balance of the overall air/fuel ratio from each cylinder. Then the air/fuel ratios in individual cylinders can be controllably adjusted to achieve relative equality of individual first local peaks of the ionization signals among the cylinders. This adjustment would be performed relatively slowly, at fairly steady engine operating conditions, so that statistical information can be gathered and analyzed by the engine controller. The controller would then determine the offset value of each fuel injector (and hence the quantity of fuel) in order to achieve approximate equality between the different cylinders. These offsets would then be used during the entire engine operating range, in order to maintain or evenly balance air/fuel ratio amongst the cylinders under all operating conditions.

Engine modeling can be utilized to determine the off-set peak ionization relative to the stoichiometric air/fuel ratio of the particular engine. This methodology can be accomplished in each cylinder separately so that individual cylinder air/fuel ratio control can be optimized to a stoichiometric mixture. Each cylinder off-set from the base engine map can be determined and then utilized to maintain that particular cylinder's stoichiometric air/fuel ratio.

Due to manufacturing imperfections and other operating variables, the amount of air and fuel delivered to each cylinder is at least slightly different. Using the air/fuel ratio control system as depicted in FIGS. 2 and 3, we can calibrate for the appropriate injection time for each cylinder's stoichiometric air/fuel ratio. The calibration of an engine is very important to the emissions level achieved in the engine. One of the things that is most difficult parameters to calibrate in an engine is the amount of air allowed into each cylinder during each cycle. This has a lot to do with intake manifold design, valve timing, cam profiles, as well as conditions of back pressure that change the EGR inherent in the engine. These difference in air admitted into the cylinder in each cycle, as well as the air admitted into each cylinder versus its neighboring cylinders, makes it difficult for conventional systems to accurately determine a stoichiometric mixture for each cylinder.

With the ability to adaptively control around the stoichiometric mixture using ionization signal data, the engine control system can achieve an accurate off-set in fuel control to accommodate the differences in each cylinder's air intake. This methodology can also accommodate for changes over the life of the engine, like clogging of fuel injectors or other wearing conditions that may change the air and fuel conditions or delivery thereof for each particular cylinder.

Certain engines, such as lawn mower engines and small utility engines, do not have the same emission standards or requirements for catalytic converters that current automotive production engines require. For these engines, an ionization methodology for air/fuel ratio control is even more valuable than it is in some automotive applications. In these engines, an ignition system is required, however, an oxygen sensor is not the optimum methodology for air/fuel ratio control given the fact that these engines in most cases meet the emission standards without a catalytic converter. These engines require accurate control of the air/fuel ratio to prevent running too rich and producing too much pollution, as well as not running too lean and overheating the engine.

In has been determined that these smaller utility engines have an optimum operating range in the vicinity of $\lambda$=0.90 to 0.95, a level at which they operate efficiently and produce reasonably low levels of hydrocarbon and carbon monoxide emissions. The control strategy for these engines is ideal for ionization detection methodology because it simply entails the maximization of the first local peak of ionization signal during almost all operating conditions of the engine. A very simple control system can be employed with an ignition system (that includes an ionization apparatus), to achieve a low-cost, accurate and efficient air/fuel ratio control system.

In other industrial engine applications, misfire detection can be employed to determine the lean operating limit of a particular engine. The lean operating limit can be determined, with the misfire detection capability of the ionization signal. Engine misfire is detected when there is little or no amplitude in the ionization signal across the entire combustion duration time frame. A control strategy that leans the air/fuel ratio just short of engine misfire, can be utilized to maximize fuel efficiency in an engine that employs an ionization detection circuitry. The control strategy utilized would be one that incrementally makes the air/fuel ratio leaner and leaner, until a misfire is detected in one of the cylinders, in a global strategy, or in each individual cylinder to determine each individual cylinder's lean misfire limit, and then backing off a certain factor from that misfiring air/fuel ratio in order to operate at a stable condition with some margin of assurance that a misfire is not going to occur. In certain small engine applications two strategies may be advantageously used. One is a maximization strategy that would be utilized at certain high speed and load conditions and the other is the lean operating limit strategy described above. The two strategies would be employed under conditions of engine operation in order to achieve the best balance between emissions and proper operation of the engine during high load conditions.

In certain engine applications the control system tuning capability makes it possible to achieve a desired air/fuel ratio simply by maximizing the ionization signal, the first or second peak of the ionization signal, or an integral of the ionization signal (or a combination thereof). This significantly simplifies the algorithm needed for achieving a desired air/fuel ratio in each cylinder.

Using the above described ionization detection and analysis and the correlation between ionization and air/fuel ratio, feedback may be provided to an air/fuel ratio control system. Each cylinder can be optimized for either a stoichiometric air/fuel ratio, or an appropriate air/fuel ratio for the operating condition desired by the engine controller.

The use of ionization sensing for cylinder-to-cylinder air/fuel ratio control supplements other potential uses of the ionization signal. See, e.g., SAE Technical Paper 980166, incorporated herein in full by reference and published by the Society of Automotive Engineers, by Eric N. Balles, Edward A. VanDyne, Alexandre M. Wahl, Kenneth Ratton, Bradley J. Darin and Ming Chia Lai, "In-Cylinder Air/Fuel Ratio Approximation Using Spark Gap Ionization Sensing". The ionization signal can deliver multiple pieces of information regarding the events and conditions in the combustion chamber. As an example, the ionization signal can determine misfire, knocking conditions, as well as variations in the cylinder pressure of an engine. Additionally, the ionization signal can be utilized to control the exhaust gas re-circulation ("EGR") system. Sensitivity of the ionization signal sensitivity to $NO_x$ in the vicinity of the second local peak can be used by the EGR system to reduce the $NO_x$ emissions. This EGR control system can utilize comparative ionization values to reduce $NO_x$ levels without the presence of misfire. The combination of magnitude of the second local peak of the ionization signal and the statistical magnitude of the misfire occurrence can be utilized together to control the maximum tolerable EGR achievable in the engine at each running condition.

It has been shown that because $NO_x$ is the most conductive of the gases resulting from combustion, the second peak of the ionization signal increases as a function of the $NO_x$ molecules available. This correlation between ionization signal and the presence of $NO_x$ molecules follows the load on the engine, whereby higher $NO_x$ emissions are indicated by higher ionization signal measurements.

The use of ionization detection and analysis can be used to minimize $NO_x$ emissions because of the direct correlation between the second local peak in the ionization signal and $NO_x$ emissions. Therefore, based upon the second local peak of the ionization signal, information about the concentration and amount of $NO_x$, present in the combustion chamber can be determined. Over a range of air/fuel ratios, $NO_x$ emissions increase as the air/fuel ratio is increased from a rich mixture to a stoichiometric mixture. $NO_x$ emissions peak at a air/fuel ratio that is slightly higher than stoichiometric, and then fall again after about a 16 to 1 air/fuel ratio (for gasoline). This air/fuel ratio ($\lambda$ between approximately 1.00 to 1.10) is typically the where $NO_x$ emissions are at their highest. Again, see FIG. 1.

Utilizing this concept, that $NO_x$ emissions peak slightly above stoichiometric and this peak corresponds to the second local peak in the ionization signal, the air/fuel ratio can be adaptively controlled based on the ionization signal. Using the relative increase in ionization signal amplitude together with the sensitivity to other information within the ionization signal, air/fuel ratio can be optimized for each cylinder. In conjunction with an oxygen sensor measuring the overall oxygen level of the entire engine, the ionization signal within each cylinder can be used to provide valuable feedback control for modifying the air/fuel ratio in individual cylinders thereby providing balance to all cylinders.

It should be understood that the preceding is merely a detailed description of certain preferred embodiments. It therefore should be apparent to those skilled in the art that various modifications and equivalents can be made without departing from the spirit or scope of the invention.

I claim:

1. An air/fuel ratio control system for an internal combustion engine to reduce emissions and increase engine efficiencies comprising:

an ionization apparatus for measuring ionization within a combustion chamber of the engine and generating an ionization signal based upon the ionization measurements; and an air/fuel ratio controller coupled to the ionization apparatus and controlling the air/fuel ratio in the combustion chamber based upon at least one of (i) substantially maximizing a first local peak in the ionization signal and (ii) a second local peak in the ionization signal.

2. The control system of claim 1 wherein the controller further controls the air/fuel ratio based upon substantially maximizing the second local peak in the ionization signal.

3. The control system of claim 1 wherein the combustion chamber of the internal combustion engine includes a plurality of cylinders, and each cylinder is independently coupled to an ionization apparatus for measuring ionization within such cylinder and generating an ionization signal based upon the ionization measurements within such cylinder.

4. The control system of claim 3 wherein the controller further controls the air/fuel ratio in the plurality of cylinders based upon a comparison of the first local peak in the ionization signals measured in each cylinder.

5. The control system of claim 4 further including an oxygen sensor on an exhaust side of the combustion chamber and coupled to the controller.

6. The control system of claim 3 wherein the controller is coupled to each of the plurality of cylinders and controls the air/fuel ratio in each cylinder independently based upon the ionization signal corresponding to the respective cylinder.

7. The control system of claim 1 wherein the ionization apparatus includes a spark plug having a spark gap.

8. The control system of claim 1 wherein the ionization apparatus includes an ionization probe.

9. The control system of claim 1 further comprising a processor coupled to the ionization apparatus and to the controller for conditioning the ionization signal.

10. The control system of claim 9 wherein the processor includes software for statistically analyzing the ionization signal.

11. The control system of claim 10 wherein the software for statistically analyzing the ionization signal averages the ionization signal over a plurality of engine cycles.

12. The control system of claim 9 wherein the processor includes software to analyze the ionization signal for a known offset from a desired air/fuel ratio and the controller controls the air/fuel ratio based upon maximizing the desired offset ionization signal.

13. The control system of claim 1 wherein the controller utilizes a predetermined offset to control the air/fuel ratio such that the air/fuel ratio is offset by a predetermined amount from the air/fuel ratio at which the first local peak in the ionization signal would be substantially maximized.

14. The control system of claim 1 wherein the controller utilizes a predetermined offset to control the air/fuel ratio such that the air/fuel ratio is offset by a predetermined amount from the air/fuel ratio at which the second local peak in the ionization signal would be substantially maximized.

15. The control system of claim 1 wherein the controller utilizes a predetermined offset to control the air/fuel ratio such that the air/fuel ratio is offset by a predetermined amount from the air/fuel ratio at which the second local peak in the ionization signal would be substantially minimized.

16. An air/fuel ratio control system for an internal combustion engine to reduce emissions and increase engine efficiencies comprising:

an ionization apparatus for measuring ionization within a combustion chamber of the engine and generating an ionization signal based upon the ionization measurements;

an air/fuel ratio controller coupled to the ionization apparatus and controlling the air/fuel ratio in the combustion chamber based upon the ionization signal; and an exhaust gas recirculation system coupled to the controller, wherein the controller further controls an exhaust gas recirculation level based upon a second local peak in the ionization signal.

17. The control system of claim 16 further comprising a misfire detection apparatus coupled to the controller and the controller further controls the exhaust gas recirculation level based upon a number of misfires detected in the engine.

18. The control system of claim 16 wherein the controller controls the exhaust gas recirculation level to substantially minimize the second local peak in the ionization signal.

19. A method for reducing emissions and increasing engine efficiencies in an internal combustion engine comprising:

detecting ionization within a combustion cylinder of the engine with an ionization apparatus;

generating an ionization signal with the ionization apparatus based upon the ionization detection; and adjusting an air/fuel mixture injected into the cylinder based upon at least one of (i) substantially maximizing a first local peak in the ionization signal and (ii) a second local peak in the ionization signal.

20. The method of claim 18 wherein the adjusting step is based upon maximizing the second local peak in the ionization signal.

21. The method of claim 18 wherein the adjusting step is based upon minimizing the second local peak in the ionization signal.

22. A method for reducing emissions and increasing engine efficiencies in an internal combustion engine comprising:

detecting ionization within a combustion cylinder of the engine with an ionization apparatus;

generating an ionization signal with the ionization apparatus based upon the ionization detection; and adjusting an air/fuel mixture injected into the cylinder based upon comparing a first local peak of the ionization signal of a first cylinder with a first local peak of an ionization signal of a second cylinder.

23. The method of claim 22 wherein the adjusting step is based upon maintaining the first local peaks of the first and second cylinder at substantially equal amplitudes.

24. An air/fuel ratio control system for an internal combustion engine to reduce emissions and increase engine efficiencies comprising:

an ionization apparatus for measuring ionization within a combustion chamber of the engine and generating an ionization signal based upon the ionization measurements; and an air/fuel ratio controller coupled to the ionization apparatus and controlling the air/fuel ratio in the combustion chamber based upon a predetermined offset from a point at which a first local peak in the ionization signal would be substantially maximized.

25. An air/fuel ratio control system for an internal combustion engine to reduce emissions and increase engine efficiencies comprising:

an ionization apparatus for measuring ionization within a first and a second combustion cylinder of the engine and generating a first and a second ionization signal based upon the ionization measurements in the first and second cylinders, respectively; and an air/fuel ratio controller coupled to the ionization apparatus and controlling the air/fuel ratio in the first and second cylinders based upon at least one of (i) comparing a first local peak of the first ionization signal with a first local peak of the second ionization signal and (ii) comparing a second local peak of the first ionization signal with a second local peak of the second ionization signal.

26. The control system of claim 25 further including an oxygen sensor on an exhaust side of the combustion chamber and coupled to the controller, wherein the controller further controls the air/fuel ratio in the first and second cylinders based upon data from the oxygen sensor.

* * * * *